US009686829B2

(12) United States Patent
Liu

(10) Patent No.: US 9,686,829 B2
(45) Date of Patent: Jun. 20, 2017

(54) LIGHT EMITTING DEVICE CURRENT REGULATOR CIRCUIT AND CONTROL METHOD THEREOF

(75) Inventor: Jing-Meng Liu, Zhubei (TW)

(73) Assignee: RICHTEK TECHNOLOGY CORPORATION, Hsin-Chu (TW)

( * ) Notice: Subject to any disclaimer, the term of this patent is extended or adjusted under 35 U.S.C. 154(b) by 1103 days.

(21) Appl. No.: 13/466,705

(22) Filed: May 8, 2012

(65) Prior Publication Data

US 2012/0286679 A1 Nov. 15, 2012

Related U.S. Application Data

(60) Provisional application No. 61/484,334, filed on May 10, 2011.

(51) Int. Cl.
*H05B 33/08* (2006.01)

(52) U.S. Cl.
CPC ..... *H05B 33/0827* (2013.01)

(58) Field of Classification Search
CPC ..... H05B 37/02; H05B 33/0812; H05B 33/0815; H05B 33/00; H05B 33/0827
USPC ..... 315/229, 185 R, 188, 192, 232, 235, 315/241 R, 291, 294, 300, 302, 306, 193, 315/209 R, 297, 307
See application file for complete search history.

(56) References Cited

U.S. PATENT DOCUMENTS 7,893,626 B2 2/2011 Liu
2001/0005319 A1 6/2001 Ohishi et al.
2008/0130288 A1* 6/2008 Catalano ..... H05B 33/0803 362/294
2011/0062876 A1* 3/2011 Yang et al. ..... 315/219
2011/0068700 A1* 3/2011 Fan ..... 315/185 R
2011/0084734 A1* 4/2011 Russell et al. ..... 327/108
2011/0266962 A1* 11/2011 Son et al. ..... 315/185 R
2011/0273101 A1* 11/2011 Liu ..... 315/192

FOREIGN PATENT DOCUMENTS

TW 481967 4/2002
TW 200802232 1/2008

* cited by examiner

*Primary Examiner* — Jimmy Vu
*Assistant Examiner* — Henry Luong
(74) *Attorney, Agent, or Firm* — Tung & Associates

(57) ABSTRACT

A light emitting device current regulator circuit is disclosed. A light emitting device circuit has a first end for receiving light emitting device operation power, and a second end. The light emitting device current regulator circuit includes: an internal voltage generation circuit coupled to the second end, for generating an internal voltage according to a second end voltage to supply electrical power to the light emitting device current regulator circuit, wherein the supply voltage generation circuit includes a charge storage device for storing charges from the second end voltage to generate the supply voltage; and a current control circuit coupled to the second end, the current control circuit regulating the light emitting device current according to a control signal, wherein the control signal at least intermittently reduces the light emitting device current to zero or low current in order to raise the second end voltage.

33 Claims, 7 Drawing Sheets

300

LIGHT EMITTING DEVICE CURRENT REGULATOR CIRCUIT AND CONTROL METHOD THEREOF

CROSS REFERENCE

The present invention claims priority to U.S. provisional application No. 61/484,334, filed on May 10, 2011.

BACKGROUND OF THE INVENTION

Field of Invention

The present invention relates to a light emitting device current regulator circuit and a control method thereof; particularly, it relates to such light emitting device current regulator circuit and control method thereof with simplified wiring and low power loss.

Description of Related Art

FIG. 1 shows a conventional flat panel display (FPD) 100, which includes a display module 150 for displaying an image; a power management circuit 130, which converts an input voltage Vin to an output voltage Vout according to a feedback signal; and multiple light emitting device strings 110 for illuminating the display module 150. Each light emitting device string 110 includes multiple light emitting devices connected in series. One end of each light emitting device string 110 is coupled to the output voltage Vout for receiving operation power; the other end thereof is coupled to the power management circuit 130 for adjusting current flowing through the light emitting device string 110, and generating the feedback signal accordingly. In some applications, the brightness of the light emitting device string 110 is adjustable; in such case, the power management circuit 130 receives a dimming signal Dim, and adjusts the brightness of the light emitting device strings 110 according to the dimming signal Dim.

The power management circuit 130 receives multiple current sense signals, such as twelve current sense signals CS1, CS2, CS3, . . . , and CS12 shown in FIG. 1, and controls current flowing through each light emitting device string 110 according to the twelve current sense signals individually.

In the aforementioned conventional FPD 100, each light emitting device string 110 needs to be coupled to the power management circuit 130 individually. The larger the size of the FPD 100 is, the more the light emitting device strings 110 are needed in number, and so are the number and length of wires required for connection. This means more complicate wiring and more space in need. For example, as shown in FIG. 1, 12 light emitting device strings 110 require 12+1 wires. Besides, if the light emitting devices are connected in series in one light emitting device string 110 by a larger number, a higher operation voltage is required, which leads to higher manufacturing cost and safety concern. Furthermore, when the number of the light emitting device string 110 or the number of the light emitting devices in one light emitting device string 110 changes, the power management circuit 130 and the wiring need to be modified correspondingly. These changes and modifications lead to a higher manufacturing cost.

FIG. 2 shows a schematic circuit of a light emitting device control circuit 200, which is filed by the same applicant as U.S. Ser. No. 13/096,421 on Apr. 28, 2011. As shown in the figure, the light emitting device control circuit 200 includes a power supply circuit 270, multiple light emitting device strings 210, and multiple light emitting device current regulator circuits 230. The power supply circuit 270 converts an input voltage Vin to an output voltage Vout according to a feedback signal FB. Each light emitting device strings 210 includes at least one and preferably multiple light emitting devices connected in series. The light emitting device string 210 has a first end E1 and a second end E2, wherein the first end E1 is coupled to the output voltage Vout to supply operation power to the multiple light emitting devices. The light emitting device current regulator circuit 230 has pins Vcc, CS, LFB, and GND. Pin Vcc receives an operation voltage which is supplied to the internal circuitry of the light emitting device current regulator circuit 230 (hereinafter referred to as internal voltage Vcc). The internal voltage Vcc is converted from the output voltage Vout or other proper power sources, such as the input voltage Vin or other DC voltages. Pin CS of the light emitting device current regulator circuit 230 is coupled to the second end E2 of the light emitting device string 210 to regulate current flowing through the light emitting device string 210. The light emitting device current regulator 230 generates a local feedback signal LFB at pin LFB. All local feedback signals LFB generated by the multiple light emitting device current regulator circuits 230 are coupled to a feedback signal pin FB of the power supply circuit 270 to provide a feedback signal FB. The feedback signal FB is determined by the lowest level among the multiple local feedback signals LFB. In some applications of the light emitting device control circuit 200, the brightness of the light emitting device strings 210 is adjustable; in such case, the light emitting device current regulator circuit 230 may include a pin Dim to receive a dimming signal Dim. The light emitting device current regulator circuits 230 receive the same dimming signal Dim, and regulate current flowing through corresponding light emitting device strings 210 according to the dimming signal Dim.

In FIG. 2, because the light emitting device current regulators 230 are provided locally and connected with the corresponding light emitting device strings 210 to become one local module, the wiring is simplified as compared with the prior art of FIG. 1. The number of the wires is greatly reduced to four, including: an output voltage common wire for delivering the output voltage Vout; a feedback signal common wire for delivering the feedback signal FB (LFB); a ground common wire for connection to ground level GND; and a dimming signal common wire for delivering the dimming signal Dim. In the prior art shown in FIG. 1, if there are N light emitting device strings 110, N+1 wires are needed. In contrast, the circuit shown in FIG. 2 obviously saves space effectively. Besides, in the prior art shown in FIG. 1, for different number of light emitting device strings 110, the internal circuitry and the number of pins of the power management circuit 130 need to be modified or re-designed. In the circuit shown in FIG. 2, the power supply circuit 270 can be used to cooperate with any number of light emitting device strings 210 without changing its internal circuitry or the number of pins, as long as the total power required does not exceed the limit. Therefore obviously, the circuit shown in FIG. 2 is more advantageous than the prior art.

However, even though the circuit shown in FIG. 2 simplifies the wiring as compared to the prior art shown in FIG. 1, it is still required to provide the internal voltage Vcc to each light emitting device current regulator circuit 230 by an additional common wire. Hence, the wiring and the power loss problems can be further improved.

In view of the foregoing, the present invention provides a light emitting device current regulator circuit and a control method thereof, which can further simplify the wiring and mitigate the power loss.

SUMMARY OF THE INVENTION

A first objective of the present invention is to provide a light emitting device current regulator circuit.

A second objective of the present invention is to provide a control method of a light emitting device current regulator circuit.

To achieve the objectives mentioned above, from one perspective, the present invention provides a light emitting device current regulator circuit, for regulating a light emitting device current flowing through a light emitting device circuit, wherein the light emitting device circuit has a first end and a second end, the first end being for receiving light emitting device operation power. The light emitting device current regulator includes: an internal voltage generation circuit coupled to the second end, which generates an internal voltage according to a voltage at the second end (second end voltage) to supply electrical power to the light emitting device current regulator, wherein the internal voltage generation circuit includes a charge storage device for storing charges from the second end voltage to generate the internal voltage; and a current control circuit, coupled to the second end, the current control circuit regulating the light emitting device current according to a control signal, wherein the control signal at least intermittently reduces the light emitting device current to zero or a low current in order to raise the second end voltage.

The aforementioned light emitting device current regulator circuit preferably further includes a determination circuit for generating the control signal, wherein the determination circuit determines to generate the control signal according to a level of the internal voltage, or according to a dimming signal and a level of the internal voltage, or according to a timing signal, or according to a dimming signal and a timing signal.

In the aforementioned light emitting device current regulator circuit, the internal voltage generation circuit preferably includes a sample-and-hold circuit or a rectifier circuit.

In the aforementioned light emitting device current regulator circuit, the sample-and-hold circuit may include: a switch circuit including a switch device coupled to the second end, the switch circuit operating the switch device according to the control signal; and the charge storage device coupled to the switch circuit for generating the internal voltage according to the operation of the switch device.

In another embodiment, the rectifier circuit may include: a diode device having a forward terminal (the forward terminal is also known as the Anode terminal) and a reverse terminal (the reverse terminal is also known as the Cathode terminal), wherein the forward terminal is coupled to the second end; and the charge storage device coupled to the reverse terminal for generating the internal voltage.

In another embodiment, the determination circuit may include: an internal voltage level obtaining circuit, such as a voltage divider circuit, a voltage-drop circuit, or a wiring circuit, for generating an internal voltage level information signal according to the internal voltage; and a setting circuit for generating the control signal according to the internal voltage level information signal.

In the aforementioned embodiment, the setting circuit preferably has a comparison circuit for generating a determination signal to determine whether to generate the control signal according to a comparison between the internal voltage level information signal and at least one predetermined level.

In the aforementioned embodiment, the light emitting device current regulator circuit may further include a logic circuit for generating the control signal according to the determination signal and the dimming signal.

In the aforementioned embodiment, the setting circuit may further include a single pulse generation circuit coupled to the comparison circuit, which generates a single pulse signal according to the determination signal, wherein the single pulse signal generates the control signal.

In another embodiment, the determination circuit may include: a timer circuit for generating the timing signal after counting a period of time; and a single pulse generation circuit for generating the control signal according to the timing signal.

In another embodiment, the determination circuit may include: a timer circuit for generating the timing signal after counting a period of time; and a single pulse generation circuit for generating the control signal according to the timing signal.

In another embodiment, the determination circuit may include: a timer circuit for generating the timing signal after counting a period of time; a single pulse generation circuit for generating a determination signal according to the timing signal; and a first logic circuit for generating the control signal according to the dimming signal and the determination signal.

In the aforementioned embodiment, the timer circuit may be reset according to the dimming signal, or reset according to the dimming signal and the determination signal.

From another perspective, the present invention provides a control method of a light emitting device current regulator circuit, the light emitting device current regulator circuit being for regulating a light emitting device current flowing through a light emitting device circuit, wherein the light emitting device circuit has a first end and a second end, the first end being for receiving light emitting device operation power. The control method comprises: generating an internal voltage by storing charges from a voltage at the second end (second end voltage) in a charge storage device to supply electrical power to the light emitting device current regulator circuit; and regulating the light emitting device current according to a control signal, wherein the control signal at least intermittently reduces the light emitting device current to zero or a low current in order to raise the second end voltage.

In the aforementioned embodiment, the control signal may be generated according to: a dimming signal; a level of the internal voltage; a timing signal; or a combination of two or more of the dimming signal, the level of the internal voltage, and the timing signal. For example, a level change of the internal voltage may generate a single pulse signal, or the timing signal may generate a single pulse signal, and the control signal may be generated according to the single pulse signal or the single signal combined with the dimming signal.

In the aforementioned embodiment, the step of generating the internal voltage preferably includes: determining whether to couple the second end voltage to the charge storage device according to the control signal.

The objectives, technical details, features, and effects of the present invention will be better understood with regard to the detailed description of the embodiments below.

DESCRIPTION OF THE PREFERRED EMBODIMENTS

Figure 1:
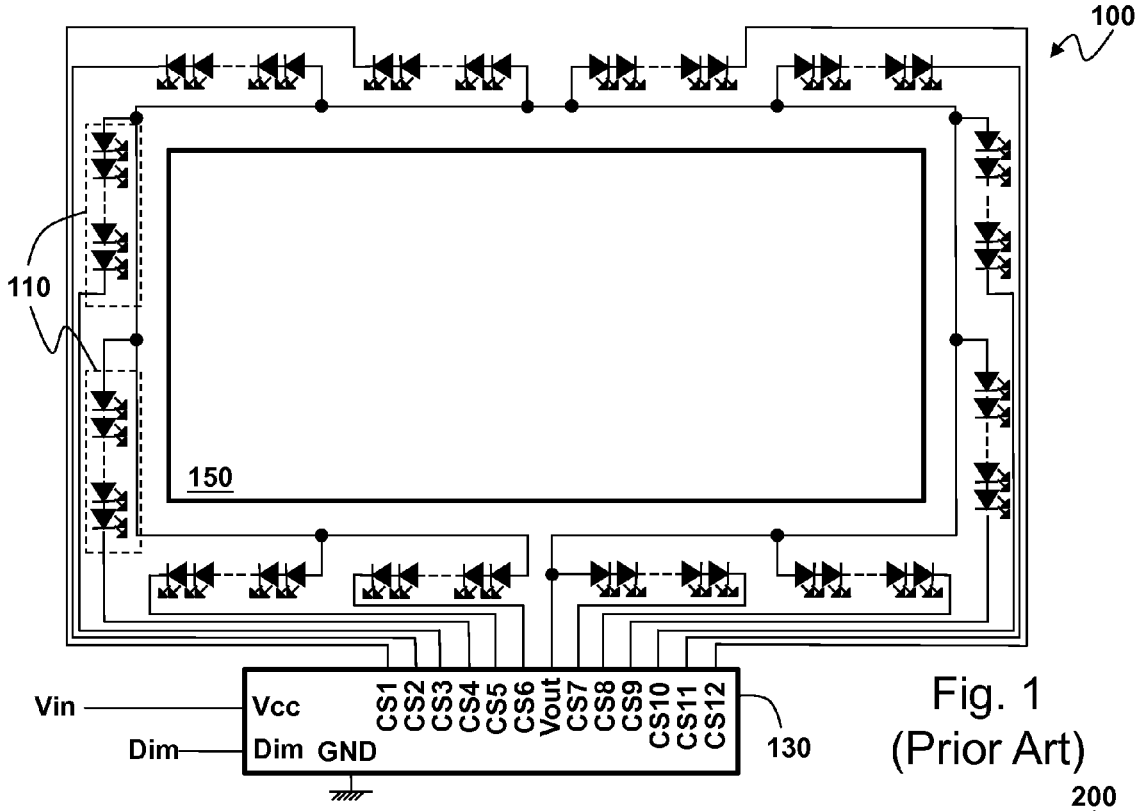
Fig. 1 (Prior Art)
FIG. 1 shows a schematic diagram of a conventional FPD.
Figure 2:
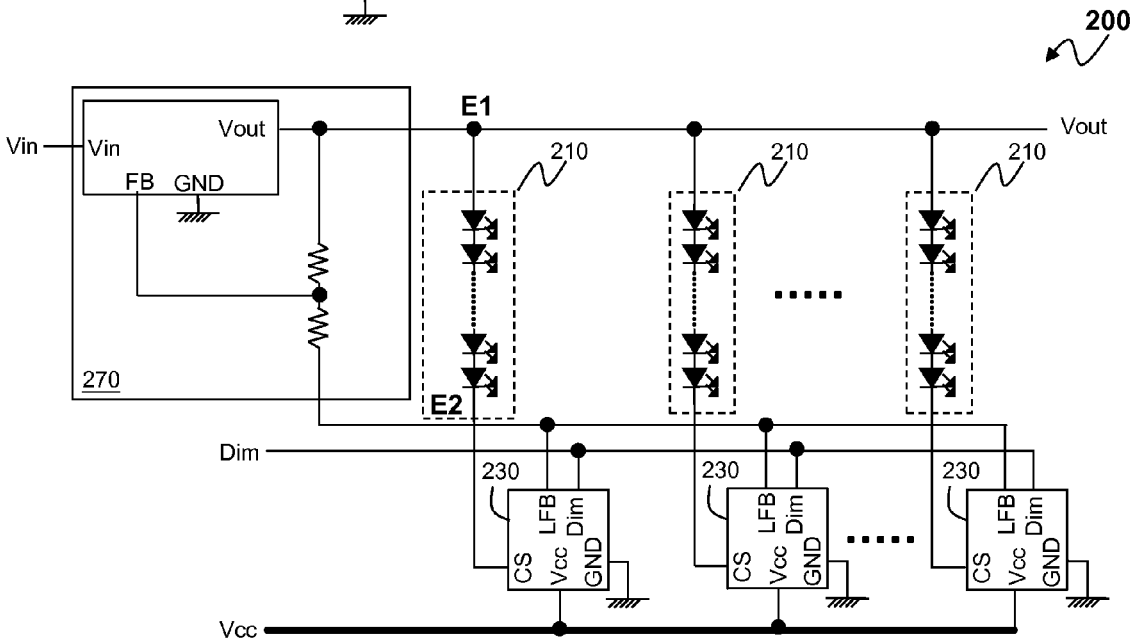
Fig. 2 (Prior Art)
FIG. 2 shows a schematic circuit of a light emitting device control circuit 200, which can simplify the wiring.
Figure 3:
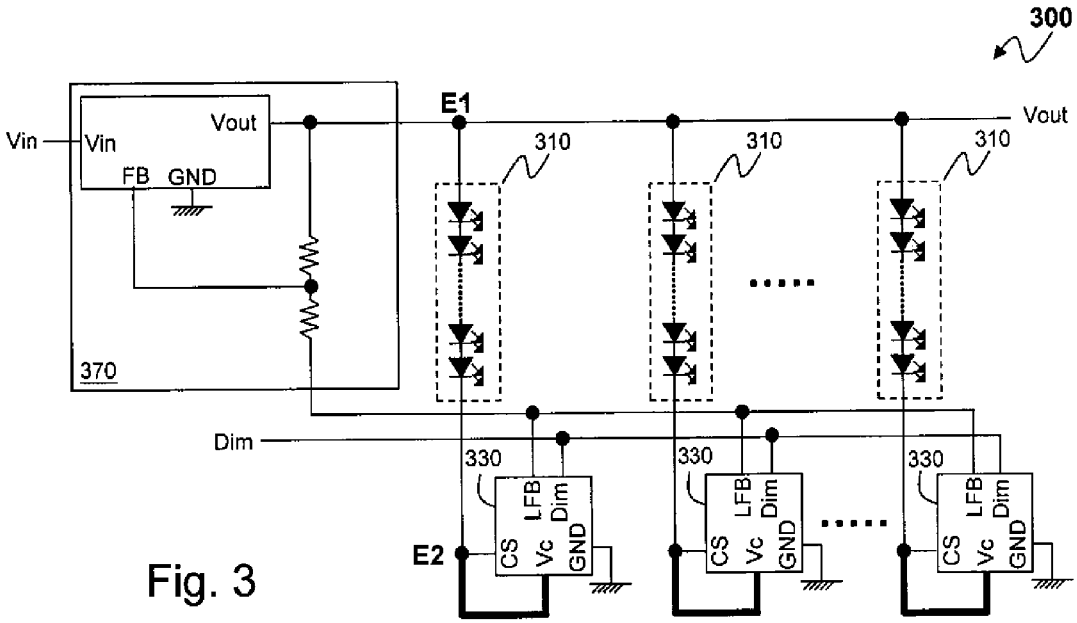
FIG. 3 shows an embodiment of the structure of the present invention.

FIG. 3 shows an embodiment of the structure of the present invention. As shown in the figure, a light emitting device control circuit 300 includes a power supply circuit 370, multiple light emitting device current regulator circuits 330, and multiple light emitting device strings 310. The power supply circuit 370 converts an input voltage Vin to an output voltage Vout according to a feedback signal FB. The light emitting device strings 310 includes at least one but preferably multiple light emitting devices connected in series. The light emitting device string 310 has a first end E1 and a second end E2, wherein the first end E1 is coupled to the output voltage Vout to supply operation power to the multiple light emitting devices. The light emitting device current regulator circuit 330 has pins Vc, CS, LFB, and GND, wherein when the light emitting device current regulator circuit 330 is integrated as an integrated circuit (IC) chip, pin Vc and pin CS may share one single pin, and the details will be described later. Pin CS of the light emitting device current regulator circuit 330 is coupled to the second end E2 of the light emitting device string 310 to regulate current flowing through the light emitting device string 310. The light emitting device current regulator 330 generates a local feedback signal LFB at pin LFB. All local feedback signals LFB generated by the multiple light emitting device current regulator circuits 330 are coupled to a feedback signal pin FB of the power supply circuit 370 to provide a feedback signal FB. The feedback signal FB is determined by the lowest level among the multiple local feedback signals LFB. In some applications, the brightness of the light emitting device strings 310 is adjustable; in such case, the light emitting device current regulator circuit 330 may include a pin Dim to receive a dimming signal Dim. The light emitting device current regulator circuits 330 receive the same dimming signal Dim, and regulate current flowing through corresponding light emitting device strings 310 according to the dimming signal Dim. The pin Dim may be omitted if the dimming function is not required. This embodiment is different from the circuit shown in FIG. 2 in that, the internal voltage Vcc of this embodiment is not converted from the output voltage Vout, or from the input voltage Vin, etc. Instead, the internal voltage Vcc is generated according to the voltage at the second end E2; the pin Vc is coupled to the second end E2 to receive the electrical power required for the light emitting device current regulator circuit 330. Note that, for easier understanding, FIG. 3 shows that the pin Vc is connected to the second end E2 by a wire external to the light emitting device current regulator circuit 330. In fact, this is only one embodiment; the wire external to the light emitting device current regulator circuit 330 is not necessary and it may be omitted. The light emitting device current regulator circuit 330 may obtain the voltage at the second end E2 by an internal wire (for example, a metal line inside the IC chip), i.e., if the light emitting device current regulator circuit 330 is manufactured as an IC chip, pin Vc and pin CS may share one same pin.

It can be found by comparing FIG. 3 with FIG. 2 that, in the present invention, because it is no more required to obtain the internal voltage Vcc externally, the wiring is less complicated and the length of the wire can be shortened. Thus, the present invention obviously saves more space. Besides, in typical applications of the light emitting device string (for example, the PFD), each light emitting device string usually includes 10 to 100 light emitting devices connected in series. Therefore, the voltage required by the light emitting device string 310, i.e., the output voltage Vout, is very high. Under such condition, if the internal voltage Vcc of the light emitting device current regulator circuit is connected to the high output voltage Vout, the light emitting device current regulator circuit needs to sustain the high voltage, and this increases the manufacturing cost of the light emitting device current regulator circuit. In contrast, the present invention converts the voltage of the second end E2 of the light emitting device string to the internal voltage Vcc of the light emitting device current regulator circuit 330, so the light emitting device current regulator circuit 330 needs not be connected to the high voltage. Apparently, the present invention can decrease the manufacturing cost and decrease the risk of damaging the circuit by the high voltage. Furthermore, in generating the internal voltage Vcc to supply internal circuit operation, the second end voltage of the light emitting device string (hereinafter referred to as the second end voltage Vcs) can be very low in normal operation, and this low dropout feature (dropout=Vcs−GND) further decreases the power consumption.

FIG. 4 shows how the present invention generates the internal voltage Vcc according to the second end voltage Vcs (the voltage at node Vc). For controlling the current flowing through the light emitting device string 310, the second end of the light emitting device string 310 is usually coupled to a current control circuit 335. If the upper end voltage of the current control circuit 335, i.e., the second end voltage Vcs, is not high enough, the current control circuit 335 cannot operate normally. Therefore, the second end voltage Vcs needs to be maintained above the minimum level required for the current control circuit 335 to operate normally. However, the second end voltage Vcs should not too high under the high current condition (high brightness) of the light emitting device string, or else there will be too much unnecessary power consumption. Therefore, when the light emitting device string is in high current condition, the second end voltage Vcs is usually controlled below 1V (volt), such as 0.3V-0.6V; generally, this is done by controlling the level of the output voltage Vout according to the feedback signal FB or the local feedback signal LFB, so that the level of the second end voltage Vcs is in the aforementioned range. However, the internal voltage Vcc is usually required to be higher than 1V to be sufficient for internal circuit operation, so the second end voltage Vcs is not high enough to supply the internal voltage Vcc. How can the second end voltage Vcs be used to supply the internal voltage Vcc? The present invention discloses the solution below.

The voltage drop across the light emitting device varies according to the current flowing therethrough, and the values of the voltage drop are different in different types of light emitting devices. Using LED as an example, between a condition where there is zero current or a low current (low current, for example, can be defined as below 10% of the current in normal operation) flowing through a light emitting diode (LED), and a normal operation condition where there is a normal operation current flowing through the LED, the voltage drop across an LED can be different as much as several hundred millivolts (mV), and the lower current results in lower voltage drop across the LED. Considering that the second end voltage Vcs is 0.3V in normal operation of the LED, then according to the present invention, it can be so arranged that the current flowing through the LED is adjusted to zero or a low current intermittently, such that the voltage drop across every LED is reduced by several hundred millivolts. (The duration of zero or low current condition is preferably short enough such that it is not perceptible by human eyes.) Because the first end E1 of the LED string is connected to the output voltage Vout, the second end voltage Vcs is: (the output voltage Vout)−(total voltage drop across the LED string). When a voltage difference of several hundred millivolts is generated across every LED, the second end voltage Vcs rises (several hundred millivolts)* (number of the LEDs in an LED string). For example, assuming that an LED string includes 10 LEDs, and 0.4V voltage difference is generated across each LED, when the current flows through the LED string is reduced to zero or low current state, the second end voltage Vcs will rise from 0.3V to 4.3V (4.3V=0.3+0.4*10). This second end voltage Vcs 4.3V will be held by the charge storage device to generate the internal voltage Vcc, and it is high enough to supply the internal circuit operation. Note that, although the output voltage Vout is controlled by the feedback signal FB or LFB, the response time from the feedback signal FB or LFB to the output voltage Vout is relatively slow, while the voltage drop (=Vout−Vcs) between the first end and the second end of the LED string changes much faster. Therefore, the second end voltage Vcs has plenty of time to rise, and the internal voltage Vcc can be generated when the second end voltage Vcs rises.

Figure 4A:
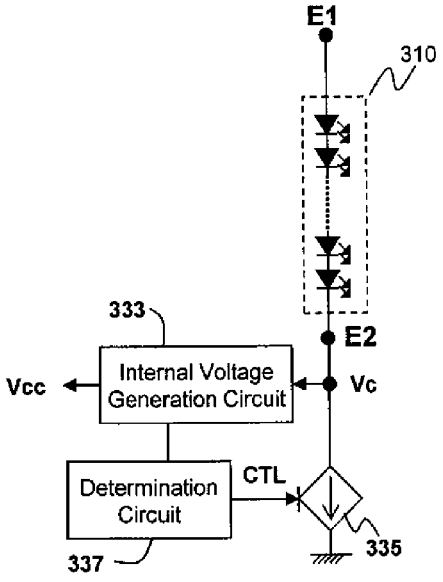
FIGS. 4A-4F show several circuit embodiments of the present invention.

Referring to FIG. 4A, according to the first circuit embodiment of the present invention, the light emitting device current regulator circuit 330 includes an internal voltage generation circuit 333, a current control circuit 335, and a determination circuit 337. The current control circuit 335 controls current flowing through the light emitting device string 310. The determination circuit 337 determines whether the level of the internal voltage Vcc is too low. If the determination circuit 337 determines that the level of the internal voltage Vcc is too low, a control signal CTL generated by the determination circuit 337 controls the current control circuit 335 to temporarily decrease current flowing through the light emitting device string, such that the second end voltage Vcs rises. When the second end voltage Vcs is higher than the internal voltage Vcc, the internal voltage generation circuit 333 coupled to the second end E2 generates the internal voltage Vcc according to the second end voltage Vcs. That is, the function of the internal voltage generation circuit 333 is to generate the internal voltage Vcc according to the second end voltage Vcs when the second end voltage Vcs is higher than the internal voltage Vcc. The details and examples will be described later.

Figure 4B:
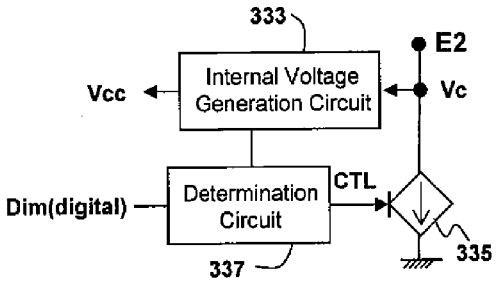

In view of the foregoing, if the light emitting device control circuit 300 (referring to FIG. 3) has a function of digital dimming (digital dimming is also known as PWM dimming), i.e., the light emitting device current regulator circuit 330 regulates the current flowing through the light emitting device string 310 according to a digital dimming signal Dim, then because the digital dimming signal Dim intermittently turns OFF the light emitting device current by its pulse width modulation operation, the determination circuit 337 should preferably generate the control signal CTL by taking this fact into consideration. As shown in FIG. 4B, in general, when the duty ratio of the digital dimming signal Dim is not 100%, the determination circuit 337 may control the current control circuit 335 directly according to the digital dimming signal Dim. (If it is for sure that the duty ratio of the digital dimming signal can never be 100%, the current control circuit 335 and the internal voltage generation circuit 333 can be directly controlled by the digital dimming signal Dim; this is equivalent to omitting the determination circuit 337. The embodiment shown in FIG. 4B covers the condition that the duty ratio of the digital dimming signal Dim may be 100%.)

Figure 4C:
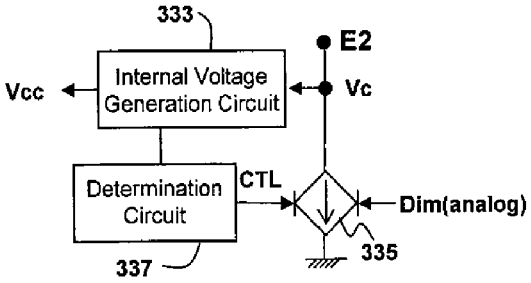

If the dimming signal Dim received by the light emitting device control circuit 300 is an analog signal, because the analog dimming signal Dim adjusts the current flowing through the light emitting device string 310 in analog manner, which does not turn OFF the light emitting device string 310 intermittently, the determination circuit 337 can control the current control circuit 335 according to its determination, without taking the condition of the analog dimming signal Dim into consideration, as shown in FIG. 4C.

Figure 4D:
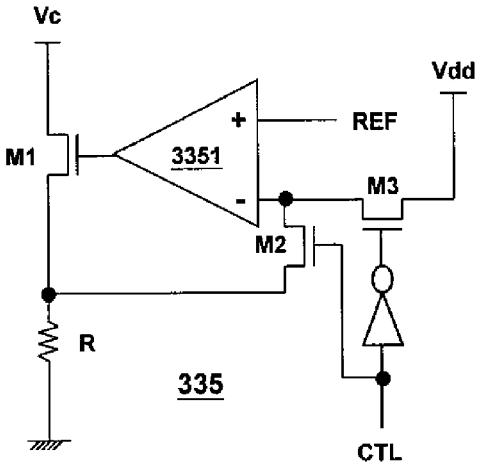
Figure 4E:
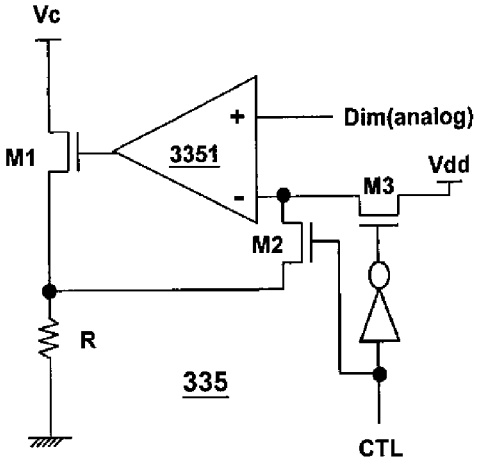

FIGS. 4D and 4E show how the control signal CTL controls the current control circuit 335 in digital and analog dimming situations, respectively. In the figures, the voltage Vdd may be any proper voltage level higher than the reference voltage REF or higher than the analog dimming signal Dim, such as the internal voltage Vcc.

In FIG. 4D, when the control signal CTL turns ON a transistor M2 and turns OFF a transistor M3, an error amplifier 3351, an transistor M1, and a resistor R form a current source circuit. The current source circuit controls the current flowing through the transistor M1 to be (REF/R), and the brightness of the light emitting device is adjusted accordingly. When the control signal CTL turns OFF the transistor M2 and turns ON the transistor M3, because the voltage Vdd is higher than the reference voltage REF, the transistor M1 is turned OFF and no current flows therethrough, so the light emitting device is OFF. The circuit shown in FIG. 4D may be used in the circuit shown in FIG. 4A or FIG. 4B.

In FIG. 4E, when the control signal CTL turns ON the transistor M2 and turns OFF the transistor M3, the error amplifier 3351, the transistor M1, and the resistor R form a current source circuit. The current source circuit controls the current flowing through the transistor M1 to be (Dim/R), and the brightness of the light emitting device is adjusted accordingly. When the control signal CTL turns OFF the transistor M2 and turns ON the transistor M3, because the voltage Vdd is higher than the analog dimming signal Dim, the transistor M1 is turned OFF and no current flows therethrough, so the light emitting device is OFF. The circuit shown in FIG. 4E may be used in the circuit shown in FIG. 4C.

Figure 4F:
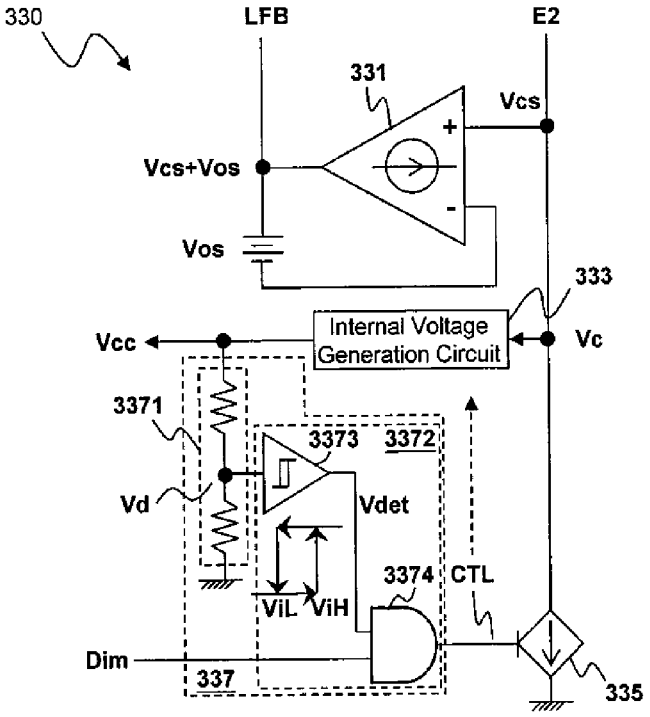

FIG. 4F shows an example of a more specific circuit embodiment of the light emitting device current regulator circuit 330. Referring to FIG. 4E together with FIG. 3, the light emitting device current regulator circuit 330 includes a sink-only voltage follower 331, an internal voltage generation circuit 333, a current control circuit 335, and a determination circuit 337. The current control circuit 335 receives the control signal CTL, and controls the current flowing through the light emitting device string 310 through the pin CS, which is noted as E2 in FIG. 4F (or node CS if the light emitting device current regulator circuit 330 is not an IC), so as to control the brightness of the light emitting device string 310. As described previously, if the voltage at the upper end of the current control circuit 335, i.e., the second end voltage Vcs, is not high enough, the current control circuit 335 cannot operate normally. Therefore, the second end voltage Vcs needs to be maintained above the minimum level required for the current control circuit 335 to operate normally. One input terminal of the sink-only voltage follower 331 receives the second end voltage Vcs at the pin CS, and the other input terminal is coupled through an optional offset voltage Vos to the output node. In other words, the voltage at the output end of the sink-only voltage follower 331 is Vcs+Vos, where Vos can be zero or not zero.

The output voltage Vout is provided to all the light emitting device strings 310. However, due to variation resulting from manufacture, the voltage across the light emitting device string 310 may be different from one another. A higher voltage drop across one light emitting device string 310 results in a relatively lower voltage at the pin CS of the corresponding light emitting device current regulator circuit 330. If the voltage at the pin CS is too low, the light emitting device current regulator circuit 330 cannot control current through the corresponding light emitting device string 310 as desired. Therefore, the output voltage Vout must be high enough to ensure all the voltages at pins CS of all the light emitting device current regulator circuits 330 are high enough. The voltage at pin CS of each light emitting device current regulator circuit 330 controls the local feedback signal LFB; to ensure that all the light emitting device current regulator circuits 330 operate normally, a proper feedback signal FB needs to be generated according to the lowest one of the feedback signals LFB, so that the output voltage Vout can be controlled accordingly. Therefore, the local feedback signals LFB are coupled to the input pin of the feedback signal FB (the local feedback signals LFB may be connected directly to the input pin FB or through a voltage divider to the input pin FB) of the power supply circuit 370 as shown in FIG. 3, and the lowest LFB will control the voltage at the input pin FB because the local feedback signals LFB are sink-only voltages.

The internal voltage generation circuit 333 is coupled to the second end E2, and it generates the internal voltage Vcc according to the second end voltage Vcs. The internal voltage Vcc is supplied to the light emitting device current regulator circuit 330 as its operation power supply. The determination circuit 337 generates the control signal CTL according to the dimming signal Dim and the internal voltage Vcc; the control signal CTL controls the current control circuit 335 which regulates the light emitting device current. In certain embodiments, the control signal CTL is not only inputted to the current control circuit 335, but also inputted to the internal voltage generation circuit 333 to control the generation of the internal voltage Vcc (details are described later referring to FIGS. 6A-6C).

In this embodiment, an illustrative example of the determination circuit 337 is shown. As shown in the figure, the determination circuit 337 includes an internal voltage level obtaining circuit 3371 and a setting circuit 3372. The internal voltage level obtaining circuit 3371 obtains information related to the level of the internal voltage Vcc, which for example may be a voltage divider circuit, a voltage drop circuit, or a wiring circuit. In this embodiment, the internal voltage level obtaining circuit 3371 is shown as a voltage divider circuit. The voltage divider circuit generates a voltage division signal Vd proportional to the internal voltage Vcc, as a signal indicating the level of the internal voltage Vcc. In the setting circuit 3372, the voltage division signal Vd is received by for example but not limited to a hysteretic trigger circuit 3373, which generates a determination signal Vdet according to the voltage division signal Vd. When the voltage division signal Vd exceeds a predetermined high level ViH, the determination signal Vdet changes from low level to high level; and when the voltage division signal Vd is lower than a predetermined low level ViL, the determination signal Vdet changes from high level to low level, as indicated by the hysteresis curves shown in the figure. The determination signal is inputted to an AND logic gate 3374, to be operated with the dimming signal Dim to generate the control signal CTL. Note that, the aforementioned embodiment of the determination circuit 337 is only for example, not for limiting the scope of the present invention. For example, if it is not necessary to take the dimming signal into consideration, the determination signal Vdet may be directly used as the control signal CTL. For another example, the hysteretic trigger circuit 3373 can be replaced by a simple non-hysteretic trigger circuit (i.e., without hysteresis function). For another example, because the purpose of the hysteretic trigger circuit 3373 is to discern the levels of the voltage division signal Vd, if a hysteretic or non-hysteretic comparator is used to compare the voltage division signal Vd with a predetermined level and generate the determination signal Vdet according to the comparison result, the same purpose can also be achieved. Therefore, the hysteretic trigger circuit 3373, the non-hysteretic trigger circuit, the hysteretic comparator, and the non-hysteretic comparator should all be deemed as embodiments of a comparison circuit. For another example, the internal voltage Vcc can be directly compared with a predetermined level; in this case the internal voltage level obtaining circuit 3371 can simply be a wire (the wiring circuit), and the internal voltage Vcc itself is the "internal voltage level information signal". For another example, the voltage divider circuit of this embodiment may be replaced by a voltage drop circuit such as a diode or other circuits or devices. For another example, the logic circuit 3374 does not have to be the AND gate as shown in the figure, and it can be other type of logic circuits according to the definitions of the high and low levels.

Figure 5:
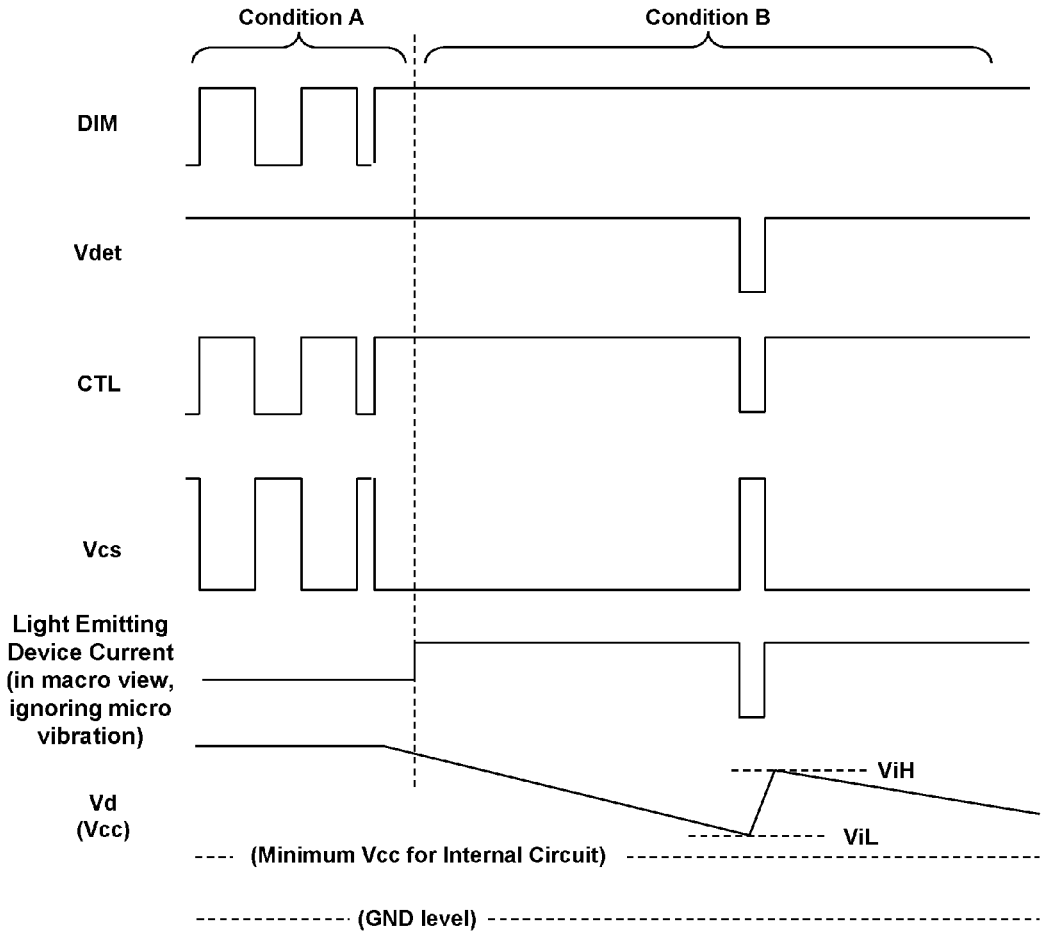
FIG. 5 shows signal waveforms of the embodiments shown in FIGS. 4A-4F.

FIG. 5 shows signal waveforms of the aforementioned embodiment. As shown in the figure, when the condition A occurs, i.e., the duty ratio of the dimming signal Dim is less than 100%, the second end voltage Vcs switches between the high and low levels. When the second end voltage Vcs is at high level, the internal voltage generation circuit 333 stores charges from the second end voltage Vcs by a charge storage device to generate the internal voltage Vcc. In this condition A, as shown in the figure, the internal voltage Vcc and its voltage division signal Vd are maintained at high level. On the other hand, when the condition B occurs, i.e., the duty ratio of the dimming signal Dim is kept at 100%, the second end voltage Vcs is kept at low level. In this case, without the help from the determination signal Vdet, the internal voltage generation circuit 333 cannot store charges to the charge storage device because the second end voltage Vcs is never at high level. Therefore, as shown in the figure, the internal voltage Vcc and its voltage division signal Vd decrease gradually. When the voltage division signal Vd is lower than the predetermined low level ViL, the determination signal Vdet changes from high level to low level. Referring to FIG. 4F, the logic circuit 3374 generates the low level control signal CTL by an AND operation of the low level determination signal Vdet and the high level dimming signal Dim. The low level control signal CTL turns OFF or decreases the current flowing through the light emitting device strings, such that the second end voltage Vcs increases and a current path between the second end E2 and the charge storage device becomes conductive. Thus, the internal voltage generation circuit 333 can store charges to the charge storage device and increase the internal voltage Vcc till the voltage division signal Vd exceeds the predetermined high level ViH. When the voltage division signal Vd is higher than the predetermined high level ViH, the determination signal Vdet changes from low level to high level, such that the current flowing through the light emitting device string returns to normal level and the second end voltage Vcs returns to low level, and the current path between the second end E2 and the charge storage device becomes non-conductive, so that the internal voltage Vcc will not be pulled low by the second end voltage Vcs. Note that, the predetermined low level ViL is preferably higher than a minimum level of the internal voltage Vcc that is required for the operation of the light emitting device current regulator circuit 330. The condition B also applies to the case where analog dimming is used, because the analog dimming signal Dim is a DC level, not a pulse width modulation signal switching between the high and low levels.

Figure 6A:
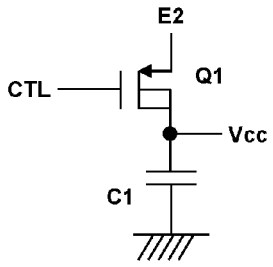
FIGS. 6A-6C show several embodiments of the internal voltage generation circuits of the present invention.
Figure 6B:
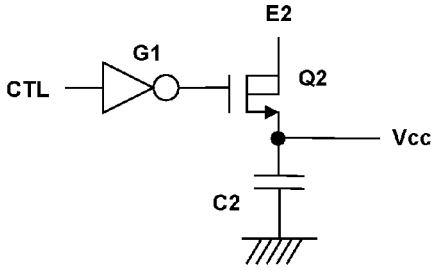
Figure 6C:
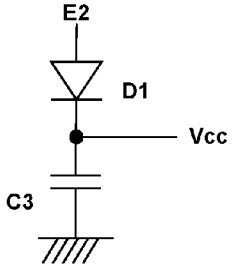

FIGS. 6A-6C show several specific embodiments of the internal voltage generation circuit for example. In the embodiments shown in FIGS. 6A and 6B, the internal voltage generation circuit includes a sample-and-hold circuit. As shown in FIG. 6A, the sample-and-hold circuit includes a switch Q1, for example but not limited to a P-type field effect transistor (PFET), which is coupled to the second end E2, and operates according to the control signal CTL; and a capacitor (a charge storage device) C1, which is coupled to the switch Q1, and generates the internal voltage Vcc according to the operation of the switch Q1. The switch Q1 shown in FIG. 6A may be replaced by an N-type field effect transistor (NFET) with corresponding amendment of the control signal CTL. For example, as shown in FIG. 6B, the sample-and-hold circuit includes a switch Q2, for example but not limited to the NFET, which is coupled to the second end E2, and operates according to the control signal CTL; a capacitor C2, which is coupled to the switch Q2, and generates the internal voltage Vcc according to the operation of the switch Q2; and a NOT logic gate G1, which performs a NOT logic operation of the control signal CTL to generate a proper signal to control a gate of the switch Q2. In summary, in the embodiments shown in FIGS. 6A and 6B, the control signal CTL determines whether the charge storage device is coupled to the second end E2 (or forming/disconnecting a current path between the second end voltage and the charge storage device in other equivalent ways) to store charges in the charge storage device so as to generate the internal voltage Vcc.

In the embodiment shown in FIG. 6C, the internal voltage generation circuit includes a rectifier circuit. As shown in FIG. 6C, the rectifier circuit includes a diode D1, which has a forward terminal and a reverse terminal, wherein the forward terminal is coupled to the second end E2; and a capacitor C3, which is coupled to the reverse terminal of the diode D1 to generate the internal voltage Vcc.

Comparing the embodiments shown in FIGS. 6A-6C with FIG. 4F, it can be readily understood that the control signal CTL needs to be inputted to the internal voltage generation circuit 333 in the embodiment shown in FIG. 6A or 6B; however, the control signal CTL does not need to be inputted to the internal voltage generation circuit 333 in the embodiment shown in FIG. 6C.

Figure 7:
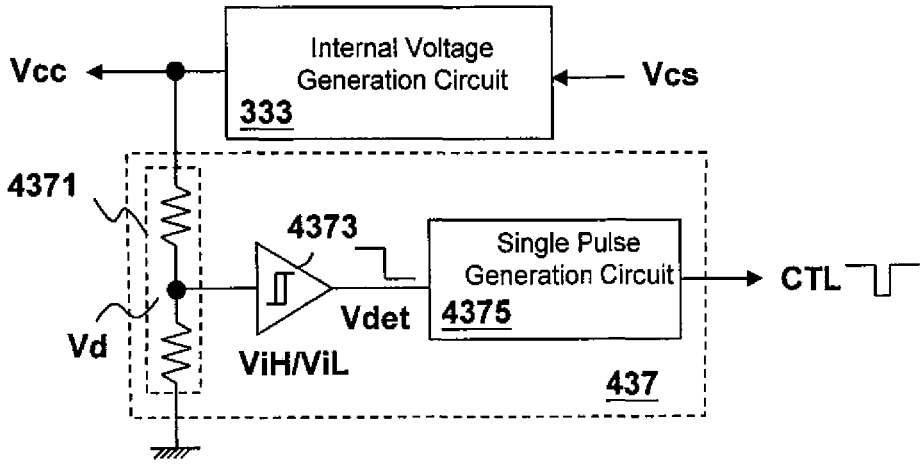
FIGS. 7-9 show several embodiments of the determination circuits of the present invention.
Figure 8:
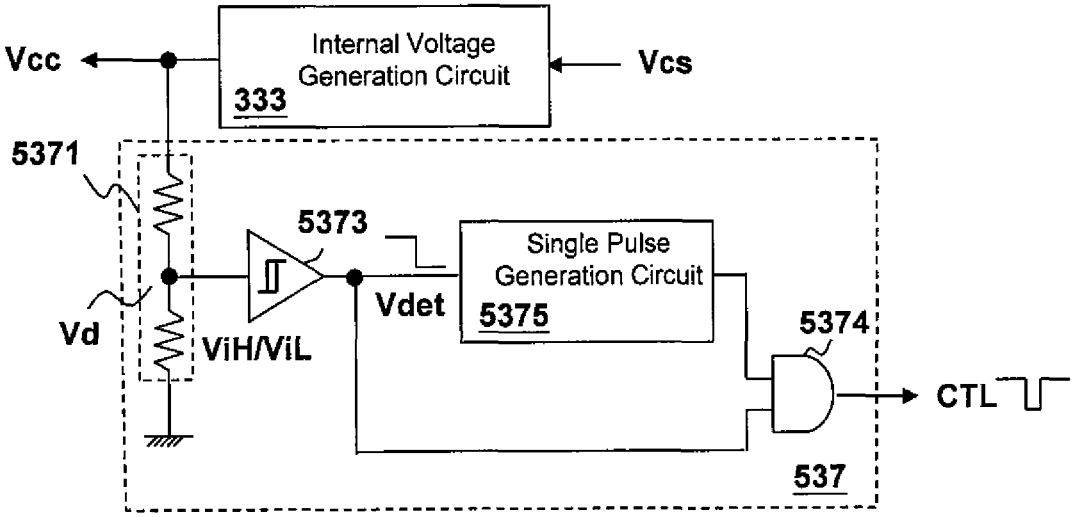
Figure 9:
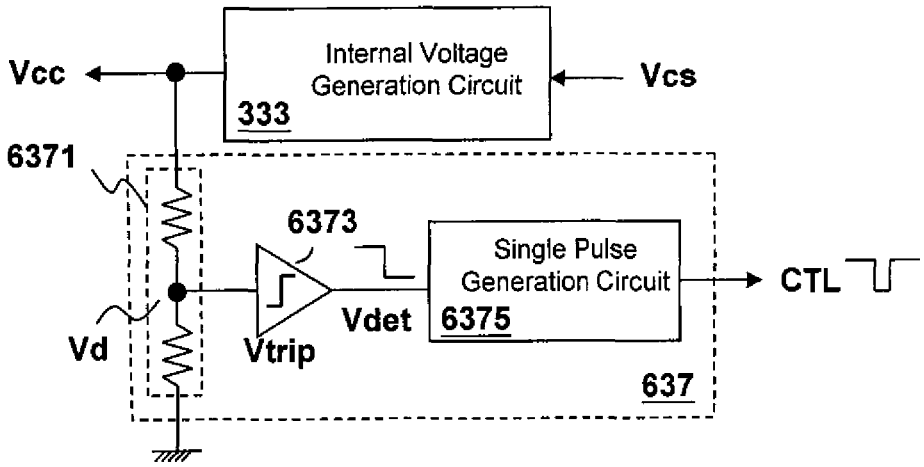

FIGS. 7-9 show several other embodiments of the determination circuit. As shown in FIG. 7, the determination circuit 437 includes an internal voltage level obtaining circuit 4371 (shown as a voltage divider circuit in this embodiment, but may be replaced by other circuits such as a voltage drop circuit or a wiring circuit), a hysteretic trigger circuit 4373 (or a comparison circuit in other forms, such as a non-hysteretic trigger circuit, a hysteretic comparator or a non-hysteretic comparator), and a single pulse generation circuit 4375. The internal voltage level obtaining circuit 4371 generates the voltage division signal Vd according to the voltage division of the internal voltage Vcc across a divider resistor (or generates the internal voltage level information signal in other forms). The voltage division signal Vd is received by for example but not limited to a hysteretic trigger circuit 4373 which generates the determination signal Vdet. When the voltage division signal Vd is lower than the predetermined low level ViL, the determination signal Vdet changes from high level to low level, and a falling edge of the change triggers the signal pulse generation circuit 4375 to generate the control signal CTL in a form of a one-shot signal (single pulse signal). In this embodiment, as shown in the figure, the one-shot control signal CTL is a low level pulse so that it is simpler for a circuit receiving the control signal CTL to process it, but the present invention is not limited to this. The control signal shown in the figure corresponds to the control signal shown in FIG. 4A or 4C. The control signal shown in FIG. 4B may be generated by performing a logic operation of the control signal CTL shown in FIG. 7 with the dimming signal Dim. The same principle (whether the control signal CTL is directly used as the control signal CTL in FIGS. 4A-4C or after certain modification by operating with the dimming signal Dim) applies to all of the embodiments described below.

FIG. 8 shows that the determination circuit 537 includes an internal voltage level obtaining circuit 5371 (shown as a voltage divider circuit in this embodiment, but may be replaced by other circuits such as a voltage drop circuit or a wiring circuit), a hysteretic trigger circuit 5373 (or a comparison circuit in other forms), a single pulse generation circuit 5375, and a logic circuit 5374. This embodiment is different from the embodiment shown in FIG. 7 in that, the determination circuit 537 includes the logic circuit 5374, which is for example but not limited to an AND logic gate circuit to generate the control signal CTL by performing an AND logic operation of the determination signal Vdet with a single pulse signal generated by the single pulse generation circuit 5375. By such arrangement, either the determination signal Vdet or the single pulse signal which stays at low level longer, determines the control signal CTL, i.e., determines the duration to store charges into the capacitor of the internal voltage generation circuit 333.

FIG. 9 shows that a determination circuit 637 includes an internal voltage level obtaining circuit 6371 (shown as a voltage divider circuit in this embodiment, but may be replaced by other circuits such as a voltage drop circuit or a wiring circuit), a trigger circuit 6373 (or a comparison circuit in other forms), and a single pulse generation circuit 6375. This embodiment is different from the embodiments shown in FIGS. 7 and 8 in that, the determination circuit 537 includes a non-hysteretic trigger circuit 6373, not the hysteretic trigger circuit 4373 or 5373. This shows that, it is not necessary for the present invention to set two reference levels to discern the voltage division signal Vd (or other forms of the internal voltage level information signal), but only one level. The non-hysteretic trigger circuit 6373 generates a trigger signal according to a comparison result of the voltage division signal Vd with, for example but not limited to, a predetermined level Vtrip. When the voltage division signal Vd is lower than the predetermined level Vtrip, the trigger signal is generated and triggers the signal pulse generation circuit 6375 to generate the control signal CTL in the form of a single pulse signal.

Figure 10:
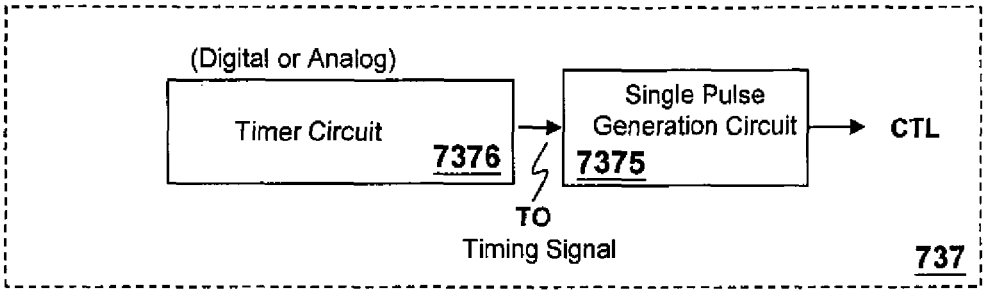
FIGS. 10-12 show several other embodiments of the determination circuits of the present invention.

FIG. 10 shows another embodiment of the present invention. This embodiment shows that a determination circuit 737 includes a timer circuit 7376 and a single pulse generation circuit 7375. The timer circuit 7376 generates a timing signal TO after it counts a predetermined period of time, and the timing signal TO triggers the single pulse generation circuit 7375 to generate the control signal CTL. The timer circuit 7376 may reset automatically after it generates the timing signal TO, or it can continue counting time until it reaches its maximum value and then goes back to its initial value (natural reset). This embodiment shows that, it is not the only way for the present invention to control the timing for storing charges to the charge storage device according to the internal voltage Vcc or its voltage division Vd; instead, the timing for storing charges may be controlled by the timer circuit 7376 every predetermined period of time. That is, as long as the light emitting device circuit is intermittently turned OFF for a short time period (or intermittently turned to a low current state for a short time period), the second end voltage Vcs can rise to charge the charge storage device of the internal voltage generation circuit to maintain the level of the internal voltage Vcc.

The timer circuit 7376 may be a digital or an analog timer circuit. The digital timer circuit for example can be but not limited to a counter. The analog timer circuit for example can be but not limited to a charge and/or discharge circuit including a capacitor.

Figure 11:
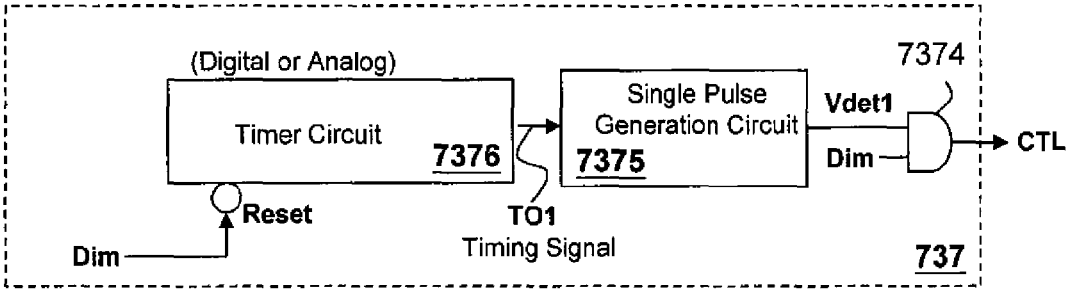

FIG. 11 shows another embodiment of the present invention. This embodiment shows that the determination circuit 737 may further take the dimming signal Dim into consideration. The timer circuit 7376 has a reset input pin Reset. When the dimming signal Dim is at low level, the timer circuit 7376 is reset. When the dimming signal is kept at high level without resetting the timer circuit 7376, the timer circuit 7376 generates a timing signal TO1 after a predetermined time to trigger the single pulse generation circuit 7375, which generates a determination signal Vdet1 according to the timing signal TO1. The timer circuit 7376 resets automatically or continues counting to a maximum value and then resets. In this embodiment, the logic circuit 7374 generates the control signal CTL according to the determination signal Vdet1 and the dimming signal Dim.

In FIG. 11, if the timer circuit 7376 is an analog timer circuit, for example but not limited to a charge and/or discharge circuit including a capacitor, the reset input pin Reset can be a terminal receiving a charge and/or discharge control signal to charge and/or discharge the capacitor.

Figure 12:
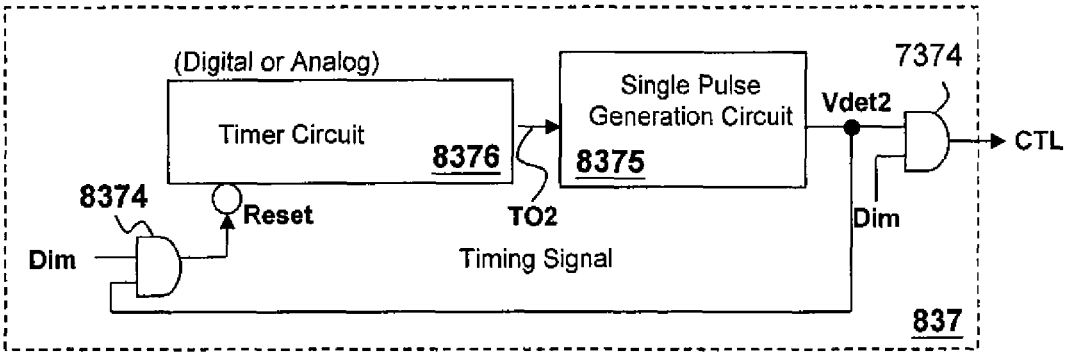

FIG. 12 shows another embodiment of the present invention. This embodiment shows that a determination circuit 837 includes not only a timer circuit 8376, a single pulse generation circuit 8375, and the logic circuit 7374, but also a logic circuit 8374. The logic circuit 8374 performs a logic operation of the dimming signal Dim with the control signal CTL, to determine whether to reset the timer circuit 8376. The timer circuit 8376 generates a timing signal TO2 after a predetermined period of time. The single pulse generation circuit 8375 generates a determination signal Vdet2 according to the timing signal TO2. The logic circuit 7374 performs a logic operation of the determination signal Vdet2 with the dimming signal Dim, and generates the control signal CTL accordingly. This embodiment shows that either the dimming signal Dim or the determination signal Vdet2 may be used to reset the timer circuit.

Figure 13A:
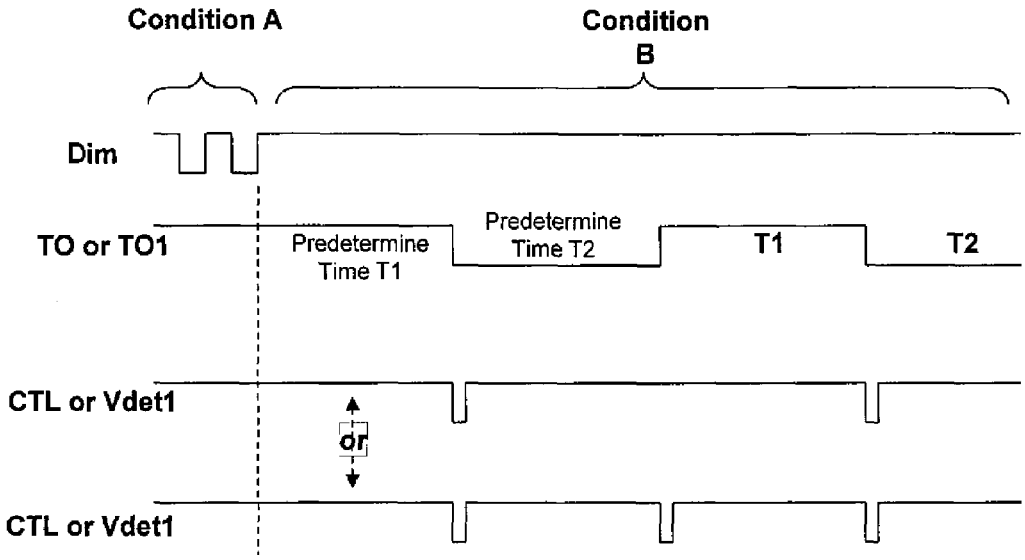
FIGS. 13A-13B show signal waveforms of the embodiments shown in FIGS. 11 and 12 to illustrate the operation of the circuits.
Figure 13B:
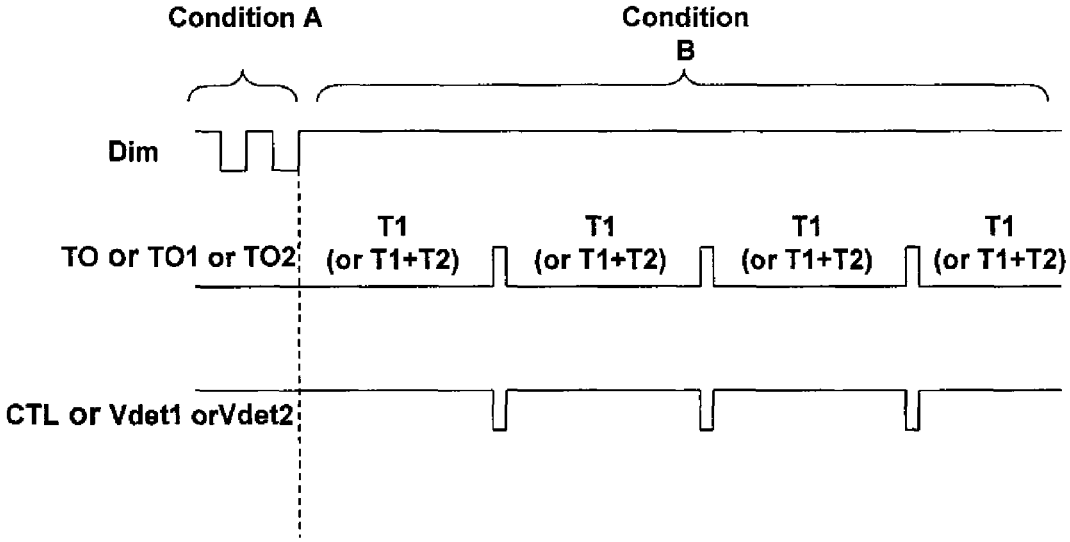

FIGS. 13A-13B show signal waveforms of the embodiments shown in FIGS. 11 and 12. As shown in the figures, when the condition A occurs, i.e., the duty ratio of the dimming signal Dim is less than 100%, the single pulse generation circuits 7375 and 8375 do not need to be triggered, and the dimming signal Dim intermittently raises the second end voltage Vcs to high level, such that the internal voltage generation circuit generates the internal voltage Vcc. Therefore, in this condition, as shown in the figures, the timing signals TO1, TO2, and the determination signals Vdet1, Vdet2 are maintained at high level. On the other hand, when the condition B occurs, i.e., the duty ratio of the dimming signal Dim is kept at 100%, and the second end voltage Vcs is kept at low level, and the internal voltage generation circuit cannot store charges naturally. The timer circuits 7376 and 8376 generate the determination signals Vdet1 or Vdet2 after a predetermined time period. The condition B also applies to the case of analog dimming.

The signal waveforms shown in FIG. 13A show a typical operation mode of the embodiments shown in FIG. 10 (Condition B only) and 11, wherein the timer circuit 7376 does not reset automatically, but continues counting to the maximum value of the timer circuit and then resets. If the timer circuit 7376 is a digital timer circuit, the waveforms of the timing signal TO or TO1 (T1/T2) may indicate the most significant bit (MSB) of the timer circuit 7376. If the timer circuit 7376 is an analog timer circuit, for example a charge (and) discharge circuit, the charging time and discharging time may be different, and the timing signals TO and TO1 may have different periods T1 and T2. One edge (for example, a falling edge) of the timing signals TO and TO1 may be used to trigger the timer circuit to generate the control signal CTL or the determination signal Vdet1, or both edges (the rising edge and the falling edge) of the timing signals TO and TO1 are used to trigger the timer circuit to generate the control signal CTL or the determination signal Vdet1. The signal waveforms shown in FIG. 13B show a typical operation mode of the embodiment shown in FIG. 12, or an operation mode wherein the timer circuit 7376 shown in FIG. 10 (Condition B only) and 11 resets itself after a CTL or Vdet1 pulse is generated. As shown in the figure, the timer circuits 7376 and 8376 count a predetermined period of time T1 (or a predetermined period of time T1+T2), and then generate the control signal CTL or the determination signal Vdet1 or Vdet2, and then reset. Note that the term "reset" is not limited to resetting to "zero", but may be any predetermined value.

The embodiments shown in FIGS. 4F, 7, 8, 9, 10, 11, and 12 are not mutually exclusive to one another, i.e., according to the present invention, the level determination and the time count may be combined.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device which does not substantially influence the primary function of a signal can be inserted between any two devices in the shown embodiments. For another example, the light emitting device is not limited to a light emitting diode as shown in the aforementioned embodiments, but it may be any light emitting device driven by a current. For another example, meanings of the high and low levels of the digital signals are interchangeable, with corresponding amendment of the circuits processing these signals. In view of the foregoing, the spirit of the present invention should cover all such and other modifications and variations, which should be interpreted to fall within the scope of the following claims and their equivalents.

What is claimed is:

1. A light emitting device current regulator circuit, for regulating a light emitting device current flowing through a light emitting device circuit, wherein the light emitting device circuit has a first end and a second end, the first end being coupled to a power supply circuit, the light emitting device current regulator circuit comprising:

an internal voltage generation circuit coupled to the second end, which generates an internal voltage according to a voltage at the second end (second end voltage) to supply electrical power to the light emitting device current regulator circuit, wherein the internal voltage generation circuit includes a charge storage device for storing charges from the second end voltage to generate the internal voltage; and a current control circuit, coupled to the second end, the current control circuit regulating the light emitting device current according to a control signal, wherein the control signal at least intermittently reduces the light emitting device current in a time period to zero or a low current in order to intermittently raise the second end voltage, and when the light emitting device current is not reduced, the second end voltage becomes lower than the internal voltage.

2. The light emitting device current regulator circuit of claim 1, further comprising a determination circuit for generating the control signal, wherein the determination circuit determines to generate the control signal according to a level of the internal voltage.

3. The light emitting device current regulator circuit of claim 2, wherein the determination circuit includes:

an internal voltage level obtaining circuit for generating an internal voltage level information signal according to the internal voltage; and a setting circuit for generating the control signal according to the internal voltage level information signal.

4. The light emitting device current regulator circuit of claim 3, wherein the setting circuit includes a comparison circuit for generating a determination signal to determine whether to generate the control signal according to a comparison between the internal voltage level information signal and at least one predetermined level.

5. The light emitting device current regulator circuit of claim 4, wherein the setting circuit further includes a single pulse generation circuit coupled to the comparison circuit, which generates a single pulse signal according to the determination signal, wherein the single pulse signal generates the control signal.

6. The light emitting device current regulator circuit of claim 1, further comprising a determination circuit for generating the control signal, wherein the determination circuit determines to generate the control signal according to a dimming signal and a level of the internal voltage.

7. The light emitting device current regulator circuit of claim 6, wherein the determination circuit includes:

an internal voltage level obtaining circuit for generating an internal voltage level information signal according to the internal voltage; and a setting circuit for generating the control signal according to the internal voltage level information signal.

8. The light emitting device current regulator circuit of claim 6, wherein the determination circuit includes:

an internal voltage level obtaining circuit, for generating an internal voltage level information signal according to the internal voltage;

a setting circuit for generating a determination signal according to the internal voltage level information signal; and a logic circuit for generating the control signal according to the determination signal and the dimming signal.

9. The light emitting device current regulator circuit of claim 7, wherein the setting circuit includes a comparison circuit for generating a determination signal to determine whether to generate the control signal according to a comparison between the internal voltage level information signal and at least one predetermined level.

10. The light emitting device current regulator circuit of claim 9, wherein the setting circuit further includes a single pulse generation circuit coupled to the comparison circuit, which generates a single pulse signal according to the determination signal, wherein the single pulse signal generates the control signal.

11. The light emitting device current regulator circuit of claim 1, further comprising a determination circuit for generating the control signal, wherein the determination circuit determines to generate the control signal according to a timing signal.

12. The light emitting device current regulator circuit of claim 11, wherein the determination circuit includes:

a timer circuit for generating the timing signal after counting a period of time; and a single pulse generation circuit for generating the control signal according to the timing signal.

13. The light emitting device current regulator circuit of claim 1, further comprising a determination circuit for generating the control signal, wherein the determination circuit determines to generate the control signal according to a dimming signal and a timing signal.

14. The light emitting device current regulator circuit of claim 13, wherein the determination circuit includes:

a timer circuit for generating the timing signal after counting a period of time; and a single pulse generation circuit for generating the control signal according to the timing signal.

15. The light emitting device current regulator circuit of claim 13, wherein the determination circuit includes:

a timer circuit for generating the timing signal after counting a period of time;

a single pulse generation circuit for generating a determination signal according to the timing signal; and a first logic circuit for generating the control signal according to the dimming signal and the determination signal.

16. The light emitting device current regulator circuit of claim 15, wherein the timer circuit is reset according to the dimming signal.

17. The light emitting device current regulator circuit of claim 15, wherein the determination circuit further includes a second logic circuit for resetting the timer circuit according to the dimming signal and the determination signal.

18. The light emitting device current regulator circuit of claim 1, wherein the internal voltage generation circuit includes a sample-and-hold circuit or a rectifier circuit.

19. The light emitting device current regulator circuit of claim 18, wherein the sample-and-hold circuit includes:

a switch circuit including a switch device coupled to the second end, the switch circuit operating the switch device according to the control signal; and the charge storage device coupled to the switch circuit for generating the internal voltage according to the operation of the switch device.

20. The light emitting device current regulator circuit of claim 18, wherein the rectifier circuit includes:

a diode device having a forward terminal and a reverse terminal, wherein the forward terminal is coupled to the second end; and the charge storage device coupled to the reverse terminal for generating the internal voltage.

21. A control method of a light emitting device current regulator circuit, the light emitting device current regulator circuit being for regulating a light emitting device current flowing through a light emitting device circuit, wherein the light emitting device circuit has a first end and a second end, the first end being coupled to a power supply circuit, the control method comprising:

generating an internal voltage by storing charges from a voltage at the second end (second end voltage) in a charge storage device to supply electrical power to the light emitting device current regulator circuit; and regulating the light emitting device current according to a control signal, wherein the control signal at least intermittently reduces the light emitting device current in a time period to zero or a low current in order to intermittently raise the second end voltage, and when the light emitting device current is not reduced, the second end voltage becomes lower than the internal voltage.

22. The control method of claim 21, further comprising: generating the control signal according to a dimming signal.

23. The control method of claim 21, further comprising: generating the control signal according to a level of the internal voltage.

24. The control method of claim 23, wherein the step of generating the control signal according to the level of the internal voltage includes: triggering a single pulse signal according to changes of the level of the internal voltage, to generate the control signal.

25. The control method of claim 21, further comprising: generating the control signal according to a dimming signal and a level of the internal voltage.

26. The control method of claim 25, wherein the step of generating the control signal according to the level of the internal voltage includes: triggering a single pulse signal according to changes of the level of the internal voltage, to generate the control signal.

27. The control method of claim 25, wherein the step of generating the control signal according to the level of the internal voltage includes:

triggering a single pulse signal according to the level of the internal voltage; and generating the control signal according to the dimming signal and the single pulse signal.

28. The control method of claim 21, further comprising: generating the control signal according to a timing signal.

29. The control method of claim 28, wherein the step of generating the control signal according to the timing signal includes: triggering a single pulse signal according to the timing signal, to generate the control signal.

30. The control method of claim 21, further comprising: generating the control signal according to a dimming signal and a timing signal.

31. The control method of claim 30, wherein the step of generating the control signal according to the timing signal includes: triggering a single pulse signal according to the timing signal, to generate the control signal.

32. The control method of claim 30, wherein the step of generating the control signal according to the level of the internal voltage includes:

triggering a single pulse signal according to the timing signal; and generating the control signal according to the dimming signal and the single pulse signal.

33. The control method of claim 21, wherein the step of generating the internal voltage includes: determining whether to couple the second end voltage to the charge storage device according to the control signal.

* * * * *